US010434760B2

(12) United States Patent
Türke et al.

(10) Patent No.: US 10,434,760 B2
(45) Date of Patent: Oct. 8, 2019

(54) COLOR CONTROL PATTERN FOR THE OPTICAL MEASUREMENT OF COLORS PRINTED ON A SHEET OR WEB SUBSTRATE BY MEANS OF A MULTICOLOR PRINTING PRESS AND USES THEREOF

(71) Applicant: KBA-NOTASYS SA, Lausanne (CH)

(72) Inventors: Thomas Türke, Lonay (CH); Harald Heinrich Willeke, Paderborn (DE); Jean-Baptiste Lanternier, Neuvecelle (FR)

(73) Assignee: KBA-NOTASYS SA, Lausanne (CH)

( * ) Notice: Subject to any disclaimer, the term of this patent is extended or adjusted under 35 U.S.C. 154(b) by 0 days.

(21) Appl. No.: 16/275,188

(22) Filed: Feb. 13, 2019

(65) Prior Publication Data

US 2019/0176461 A1 Jun. 13, 2019

Related U.S. Application Data

(62) Division of application No. 13/878,336, filed as application No. PCT/IB2011/054453 on Oct. 10, 2011, now abandoned.

(30) Foreign Application Priority Data

Oct. 11, 2010 (EP) ..... 10187099

(51) Int. Cl.
*B41F 9/02* (2006.01)
*B41F 11/02* (2006.01)
(Continued)

(52) U.S. Cl.
CPC ..... *B41F 11/02* (2013.01); *B41F 9/021* (2013.01); *B41F 9/028* (2013.01); *B41F 33/0045* (2013.01); *B41P 2233/51* (2013.01)

(58) Field of Classification Search
CPC ..... B41F 11/02; B41F 9/021; B41F 9/028; B41F 33/0045; B41F 33/0054; B41F 33/0027; B41P 2233/51
See application file for complete search history.

(56) References Cited

U.S. PATENT DOCUMENTS 4,660,159 A * 4/1987 Ott ..... B41F 33/00 101/335
4,947,746 A * 8/1990 Jeschke ..... B41F 33/0081 101/181

(Continued)

*Primary Examiner* — David H Banh
(74) *Attorney, Agent, or Firm* — Nixon & Vanderhye P.C.

(57) ABSTRACT

There is described a color control pattern (CP) for the optical measurement of colors printed on a sheet or web substrate (S) by means of a multicolor printing press, especially by means of a multicolor security printing press, which substrate (S) exhibits an effective printed region (EF) having a multicolor printed image comprising a plurality of juxtaposed colored areas (A-H) printed with a corresponding plurality of printing inks of different colors, wherein the color control pattern (CP) is located in a margin portion (Im) of the substrate (S) next to the effective printed region (EF). The color control pattern (CP) comprises one or more color control strips (a-d) extending transversely to a direction of transport (T) of the substrate (S), each color control strip (a-d) comprising a plurality of distinct color control fields (CF, $CF_A$ to $CF_H$) consisting of printed fields of each relevant printing ink that is printed in the effective printed region (EF). The color control fields (CF, $CF_A$ to $CF_H$) are coordinated to actual application of the relevant printing inks in the effective printed region (EF) and are positioned transversely to the direction of transport (T) of the substrate (S) at locations corresponding to actual positions where the relevant printing inks are applied in the effective printed region (EF).

14 Claims, 7 Drawing Sheets

(51) Int. Cl.
*B41F 33/02* (2006.01)
*B41F 33/00* (2006.01)

(56) References Cited

U.S. PATENT DOCUMENTS 5,023,812 A * 6/1991 Pfeiffer ..... B41F 33/0036 358/1.1
5,122,977 A * 6/1992 Pfeiffer ..... B41F 33/0045 101/211
5,724,259 A * 3/1998 Seymour ..... B41F 33/0036 101/211
6,101,939 A * 8/2000 Giori ..... B41F 11/02 101/177
2003/0217658 A1* 11/2003 Yamamoto ..... B41F 33/0045 101/350.1
2003/0217660 A1* 11/2003 Yamamoto ..... B41F 33/0045 101/365
2004/0159254 A1* 8/2004 Mogi ..... B41F 33/0045 101/484
2004/0177784 A1* 9/2004 Yamamoto ..... B41F 33/0045 101/484
2004/0226469 A1* 11/2004 Yamamoto ..... B41F 33/0054 101/484
2005/0087085 A1* 4/2005 Fukui ..... B41F 33/0054 101/147
2006/0285181 A1* 12/2006 Fukui ..... B41F 33/0045 358/504
2007/0079717 A1* 4/2007 De Vries ..... B41F 33/0036 101/484
2007/0081204 A1* 4/2007 Ehbets ..... B41F 33/0036 358/504
2007/0208523 A1* 9/2007 Britsch ..... B41F 33/0027 702/83
2008/0314268 A1* 12/2008 Billmaier ..... B41F 33/0036 101/211
2010/0116164 A1* 5/2010 Turke ..... B41F 31/045 101/491
2012/0194593 A1* 8/2012 Kurata ..... B41F 33/0045 347/15
2017/0348966 A1* 12/2017 Walczak ..... B41F 33/0045

* cited by examiner

COLOR CONTROL PATTERN FOR THE OPTICAL MEASUREMENT OF COLORS PRINTED ON A SHEET OR WEB SUBSTRATE BY MEANS OF A MULTICOLOR PRINTING PRESS AND USES THEREOF

This application is a divisional of U.S. application Ser. No. 13/878,336 filed Aug. 9, 2013, which is the U.S. national phase of International Application No. PCT/IB2011/054453 filed Oct. 10, 2011 which designated the U.S. and claims priority to EP 10187099.6 filed Oct. 11, 2010, the entire contents of each of which are hereby incorporated by reference.

TECHNICAL FIELD

The present invention generally relates to a color control pattern for the optical measurement of colors printed on a sheet or web substrate by means of a multicolor printing press, especially by means of a multicolor security printing press, and to a printed sheet or web substrate comprising the same. The present invention further relates to a color measurement system making use of such a color control pattern, in particular for performing in-line color measurements in a multicolor printing press and, possibly, for automatically adjusting and/or setting inking units of the multicolor printing press. The present invention also relates to a multicolor security printing press for the production of security documents, such as banknotes, comprising such a color measurement system.

BACKGROUND OF THE INVENTION

Color measurement systems, especially for performing in-line color measurements in a multicolor printing press and, possibly, automatic adjustment and/or setting of inking units of the printing press are already known as such in the field of commercial printing. Such known systems are typically used in connection with commercial offset printing presses that are used to print various types of commercial products using the well-known four-color CMYK (Cyan-Magenta-Yellow-Key Black) subtractive color model, i.e. by printing multicolor patterns consisting of a combination of halftone raster patterns printed using the four primary colors Cyan, Magenta, Yellow and Black.

International application No. WO 2007/110317 A1 (and corresponding US publication No. US 2010/0116164 A1), which is incorporated herein by reference in its entirety, for instance discloses a method for adjusting an inking unit of a printing press. During a setup phase of the printing press, a small number of sheets are run through the printing press and the resulting printed sheets are inspected by means of a first measuring device (which is not integrated into the printing press), such as a densitometer, color spectrometer or a measuring instrument for combined densitometric and colorimetric measurements. The values measured by the first measuring device are compared to predetermined reference values and adjustments of the inking units of the printing press are made so that the values measured by the first measuring device match as closely as possible the desired reference values. A set of "first actual values" representative of the desired settings are thereby determined and stored as a result of the setup phase and the printing press can be released for production runs. At least a second measuring device is provided downstream of the printing units of the printing press in order to inspect the sheets during production, which second measuring device is installed in the printing press. Such second measuring device is for instance embodied as an in-line inspection system comprising at least one camera system and at least one illumination unit. The camera system is typically a color camera system comprising a line-scan sensor or an array sensor based on CCD or CMOS technology. The illumination unit typically comprises light-emitting diodes, or LEDs, or like illumination elements. The second measuring device records an image of at least one, preferably of all of the sheets which are printed on the printing press and converts the recorded images to digital image data which is fed to an image processing system as a set of "second actual values". During a learning phase, the set of "second actual values" is measured and stored as reference values for controlling an adjustment unit which adjusts the inking units of the printing press. Upon completion of the learning phase, all further printed products which are produced on the printing press are evaluated on the basis of the reference values that were established during the learning phase and any deviation between the reference values and the measured values which exceeds an acceptable tolerance is corrected by means of the adjustment unit.

According to WO 2007/110317 A1, measurements are typically made on at least one measuring strip (or "color control strip") that forms part of the patterns printed on the sheets, which measuring strip is typically located in a margin of the sheet, such as the margin at the leading edge of the sheet, outside the effective printed region of the sheet where the actual prints are carried out.

An example of such a measuring strip is disclosed in German patent application No. DE 10 2008 041 426 A1. This measuring strip comprises a plurality of juxtaposed color control fields, including color control fields printed in the primary colors (i.e. Cyan, Magenta, Yellow, Black colors), which color control fields are positioned in dependence of the relevant inking zones of the inking units of the printing press where ink adjustments are carried out.

European patent No. EP 0 142 469 B1 (and corresponding U.S. Pat. No. 4,660,159—see also EP 0 142 470 B1 and U.S. Pat. No. 4,665,496) discloses a method for adjusting an inking unit of a printing press. Reference reflectance values for a printed sheet are determined outside of the printing press by means of a scanning device, such as a plate scanner. Actual reflectance values of printed sheets which are being printed on the printing press are measured during production using a densitometer. The actual reflectance values and the reference reflectance values are compared with one another in a computer system. Based on the results of this comparison, control values for adjusting the inking units are calculated and ink feed elements are controlled on the basis of these control values. According to EP 0 142 469 B1, measurements are made directly in the printed image itself, the printed image being subdivided into a plurality of image elements whose reflectance values are measured. In this way, the use of special color measuring strips may be eliminated.

International application No. WO 2005/108083 A1 (and corresponding U.S. Pat. No. 7,515,267 B2) discloses a method for determining color and/or density values for monitoring and/or regulating a printing process in a printing apparatus, especially for use in a sheet-fed commercial offset printing press. According to WO 2005/108083 A1, measuring areas of a printed sheet are measured photoelectrically during the printing process and color and/or density values for the relevant measuring areas are determined. Deviations in the measured color and density values, as compared to measurements made outside of the printing press, are corrected.

International application No. WO 2005/108084 A1 (and corresponding U.S. Pat. No. 7,398,733 B2) discloses a method for in-line measurement of spectral, densitometric or color values measured on sheets being printed on a sheet-fed commercial offset printing press, which method involves a color calibration process. Measurements are made on a color control strip (see FIG. 9 of WO 2005/108084 A1) that is printed next to the effective printed region where the actual prints are carried out. Such color control strip comprises a plurality of juxtaposed color control fields, including control fields printed in the primary colors (i.e. Cyan, Magenta, Yellow, Black colors), which control fields are positioned in dependence of the relevant inking zones of the inking units.

U.S. Pat. No. 5,724,259 discloses a system and method for monitoring color in a commercial offset printing press. Measurements are made on a color bar (or "color control strip"—see in particular FIG. 5a of U.S. Pat. No. 5,724,259) comprising a plurality of juxtaposed color control fields printed in the primary colors (i.e. Cyan, Magenta, Yellow, Black colors) and with different tones (e.g. 100%, 75%. 50%, 25%) and combinations thereof including Blue (i.e. subtractive addition of Cyan and Magenta colors), Red (i.e. subtractive addition of Magenta and Yellow colors) and Green (i.e. subtractive addition of Cyan and Yellow colors).

European patent No. EP 0 394 681 B1 (and corresponding U.S. Pat. No. 5,023,812) discloses a method for controlling ink feed of a printing press wherein a sheet printed by the printing press is measured photoelectrically in a color control strip having a plurality of juxtaposed color-measuring fields, color measurement being carried out by a measuring head forming part of a densitometer or spectrometer, which measuring head scans the color control strip. A similar approach is disclosed in European patent No. EP 0 337 148 B1 (and corresponding U.S. Pat. No. 5,122,977).

European patent application No. EP 0 434 072 A2 also discloses color control strips for use in conventional four-color commercial offset printing. Further examples of color control strips or like color control elements are disclosed in European patent No. EP 0 590 282 B1, German patent publication DE 10 2007 029 211 A1 (see also corresponding US publication No. US 2008/0314268 A1), and U.S. Pat. No. 4,947,746.

All of the above known solutions are used for performing color measurements in commercial offset printing presses, i.e. printing presses of the type based on four-color composite printing using the CMYK subtractive color model. Printing presses of this type comprises at least four distinct printing towers which are each designed to print one of the four primary colors. Additional printing towers may be provided to print special colors and/or for the purpose of coating the printed substrates.

The above solutions are satisfactory as far as applications to commercial offset printing presses are concerned and basically require the use of a rather simple color control strip comprising a plurality of color control fields representative of the relevant primary colors that are printed (i.e. Cyan, Magenta, Yellow, Black) and, possibly, simple combinations thereof (e.g. Blue/Cyan+Magenta, Red/Magenta+Yellow, and Green/Cyan+Yellow) and/or additional special colors.

Commercial four-color offset printing is based on the printing of different raster patterns of each one of the four primary colors which are combined together to create, by subtractive color combination, a visual impression of various multicolor tones. In that respect, the design of the color control strip, and more precisely the locations of the relevant color control fields, bears no real importance, all of the relevant primary colors being typically distributed over the whole surface of the printed product.

The typical approach in terms of design of the relevant color control strips is to design those in dependence of the relevant ink zones where ink is applied and can be adjusted. The known color control strips therefore typically consist of a repetition, for each ink zone, of a predetermined succession of color control fields.

In contrast to commercial (offset) printing, security printing (as applied for instance for the production of banknotes) is not at all based on the use of a four-color printing process relying on the CMYK subtractive color model. Rather, solid patterns are printed using different printing inks of the desired colors (i.e. a blue pattern is printed using a blue printing ink, a brownish pattern using a brownish ink, a copper-like pattern using a copper-coloured printing ink, etc.).

Typical color control strips as used in commercial printing are not suitable for security printing applications for the purpose of measuring the printed colors, even less for the purpose of automatically controlling the ink supply. There is therefore a need for a new and improved solution which can suitably cope with the specific requirements of security printing.

SUMMARY OF THE INVENTION

A general aim of the invention is therefore to improve the known color control elements and provide a solution that is adapted to the specific requirements of security printing.

More specifically an aim of the present invention is to provide such a solution that permits optimal measurement of the colors printed on the sheet or web substrate, in particular for the purpose of performing in-line color measurements in a multicolor printing press, especially in a multicolor security printing press.

Still another aim of the present invention is to provide such a solution that is suitable for carrying out closed-loop color control operations in a multicolor printing press, especially in a multicolor security printing press.

These aims are achieved thanks to the solution defined in the claims.

There is accordingly provided a color control pattern as defined in claim 1, namely a color control pattern for the optical measurement of colors printed on a sheet or web substrate by means of a multicolor printing press, especially by means of a multicolor security printing press, which substrate exhibits an effective printed region having a multicolor printed image comprising a plurality of juxtaposed colored areas printed with a corresponding plurality of printing inks of different colors, wherein the color control pattern is located in a margin portion of the substrate next to the effective printed region. Such color control pattern comprises one or more color control strips extending transversely to a direction of transport of the substrate, each color control strip comprising a plurality of distinct color control fields consisting of printed fields of each relevant printing ink that is printed in the effective printed region. These color control fields are coordinated to actual application of the relevant printing inks in the effective printed region and are positioned transversely to the direction of transport of the substrate at locations corresponding to actual positions where the relevant printing inks are applied in the effective printed region.

Preferably, the effective printed region consists of a matrix of individual multicolor prints, especially multicolor security prints, arranged in multiple rows and columns and the color control pattern comprises an individual color control pattern for each column of individual multicolor prints. All such individual color control patterns are advantageously identical.

Advantageous designs of the color control pattern are described hereinafter.

Also claimed is a printed sheet or web substrate comprising a color control pattern as defined above, which color control pattern is printed on one or both sides of the substrate.

There is also provided a color measurement system, comprising an optical measurement system for measuring the colors printed on the substrate, wherein the optical measurement system is designed to carry out measurement of the colors printed on the sheet or web substrate in a color control pattern as defined above.

Advantageously, portions of the color control pattern that are affected by features embedded within, applied or printed onto, or otherwise provided in or on the substrate, such as security threads, watermarks, applied foil material, iridescent stripes and the like, are not considered for the purpose of color measurement.

There is also claimed a multicolor security printing press for the production of security documents, such as banknotes, comprising a color measurement system as defined above. Such multicolor security printing press is preferably an offset printing press, especially a Simultan-type offset printing press for the simultaneous recto-verso printing of sheets or webs.

The instant color control pattern and printed sheet or web substrate (and color measurement system) can advantageously be used for the purpose of:

(i) performing in-line color measurements in a multicolor printing press, especially in a multicolor security printing press; and/or (ii) automatically adjusting and/or setting inking units of a multicolor printing press, especially of a multicolor security printing press.

Similarly, the instant color control pattern and printed sheet or web substrate (and color measurement system) can advantageously be used for the purpose of performing off-line color measurements.

Also claimed is a set of printing plates for the impression of a color control pattern or the impression of a sheet or web substrate as defined above, wherein each of the printing plates of the set comprises a relevant subset of the color control fields forming the color control pattern.

Advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 1A:
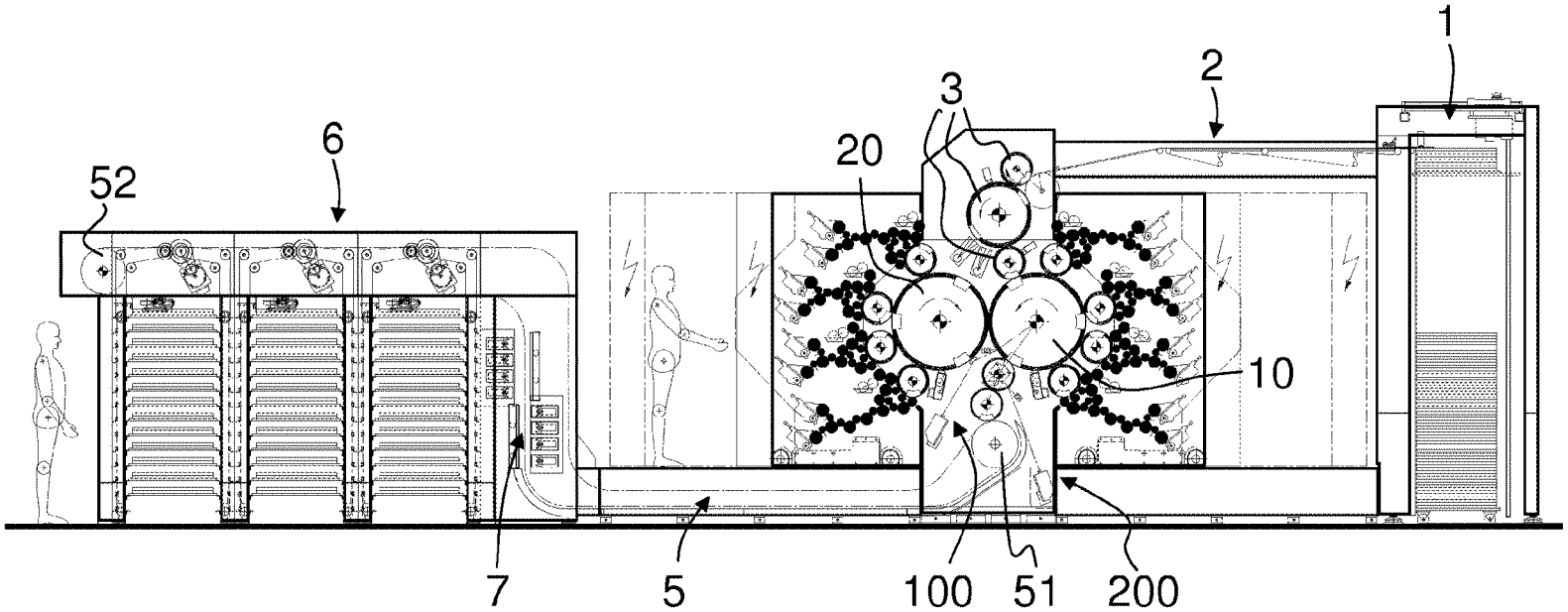
FIG. 1A is a side view of a known Simultan-type multicolor security printing press for simultaneous recto-verso printing of sheets for the production of security documents, such as banknotes.
Figure 1B:
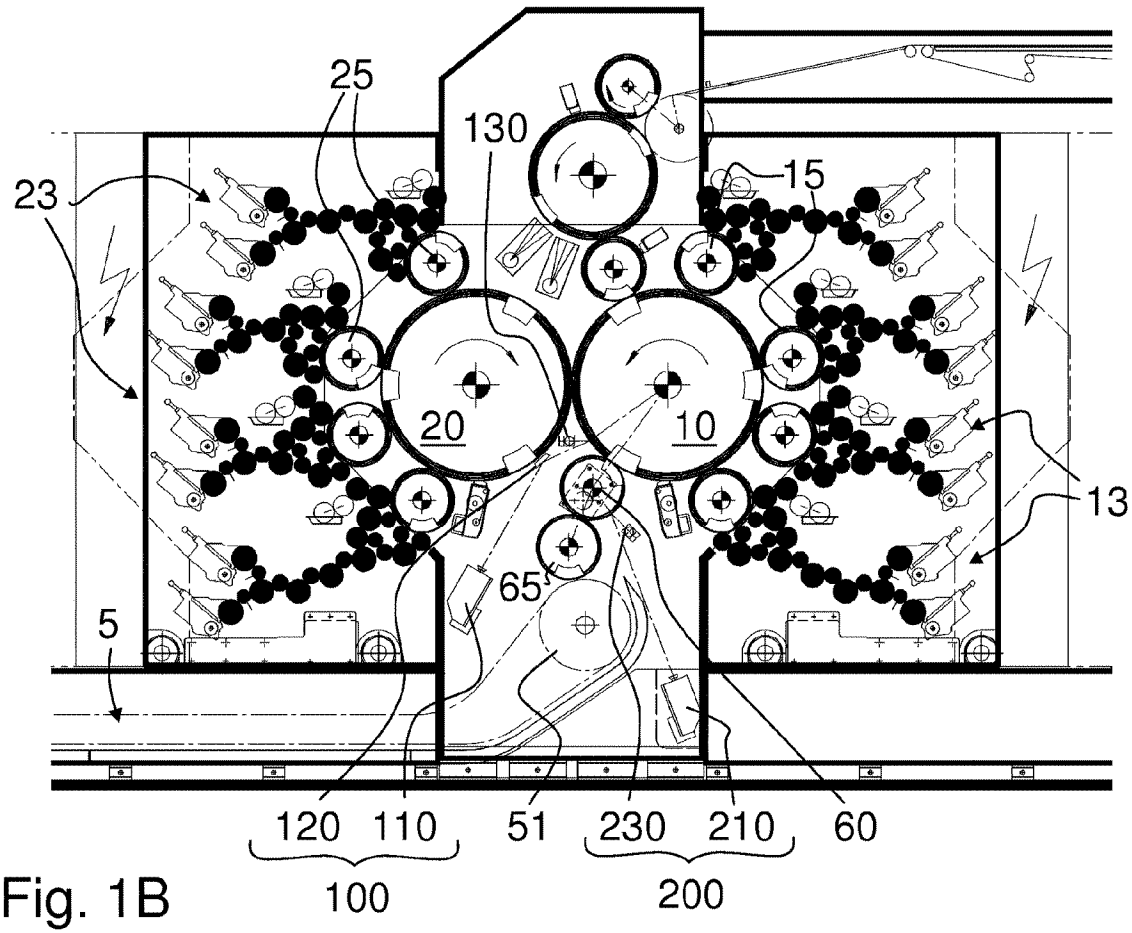
FIG. 1B is an enlarged side view of the printing group of the security printing press of FIG. 1A, which enlarged view also shows the presence of a recto-verso inspection system for inspecting the printed sheets.

The invention will be described hereinafter in the context of a sheet-fed offset printing press for the simultaneous recto-verso printing of sheets for the production of security documents, such as banknotes. Such a security printing press is illustrated in FIGS. 1A and 1B and can be generally referred to as a so-called "Simultan-type" security printing press, as printing of the sheets is carried out on both sides of the sheets in a simultaneous manner. Such a Simultan-type printing press is sold by the instant Applicant under the registered trademark "Super Simultan®".

The security printing press illustrated in FIGS. 1A and 1B is already described in International application No. WO 2007/105059 A1 (and corresponding US publication No. US 2009/0025594 A1), which publication is incorporated herein by reference in its entirety. Further information about such printing presses is also disclosed in European patent No. EP 0 949 069 B1 (and corresponding U.S. Pat. No. 6,101,939) and International applications Nos. WO 2007/042919 A2 (and corresponding US publication No. US 2008/0271620 A1) and WO 2007/105061 A1 (and corresponding US publication No. US 2009/0007807 A1). All of the above listed applications are incorporated herein by reference in their entirety.

FIGS. 1A and 1B are side views of a sheet-fed offset printing press equipped with an inspection system 100, 200 for the recto-verso inspection of the printed sheets. The printing group of the press, which is adapted in this case to perform simultaneous recto-verso offset printing of the sheets, comprises in a conventional manner two blanket cylinders (or impression cylinders) 10, 20 rotating in the direction indicated by the arrows and between which the sheets are fed to receive multicolor impressions. In this example, blanket cylinders 10, 20 are three-segment cylinders. The blanket cylinders 10, 20 receive different ink patterns in their respective colors from plate cylinders 15 and 25 (four on each side) which are distributed around the circumference of the blanket cylinders 10, 20. These plate cylinders 15 and 25, which each carry a corresponding printing plate, are themselves inked by corresponding inking units 13 and 23, respectively, in a manner known in the art. The two groups of inking units 13 and 23 are advantageously placed in two inking carriages that can be moved toward or away from the centrally-located plate cylinders 15, 25 and blanket cylinders 10, 20.

Sheets are fed from a feeding station 1 located at the right-hand side of the printing group illustrated in FIGS. 1A and 1B onto a feeder table 2 and then to a succession of transfer cylinders 3 (three cylinders in this example) placed upstream of the blanket cylinders 10, 20. While being transported by the transfer cylinders 3, the sheets may optionally receive a first impression on one side of the sheets using an additional printing group (not illustrated) as described in European patent No. EP 0 949 069 B1 and International application No. WO 2007/042919 A2, one of the transfer cylinders 3 (namely the two-segment cylinder in FIGS. 1A, 1B) fulfilling the additional function of impression cylinder. In case the sheets are printed by means of the optional additional printing group, these are first dried before being transferred to the blanket cylinders 10, 20 for simultaneous recto-verso printing. In the example of FIGS. 1A and 1B, the sheets are transferred onto the surface of the first blanket cylinder 10 where a leading edge of each sheet is held by appropriate gripper means located in cylinder pits between each segment of the blanket cylinder. Each sheet is thus transported by the first blanket cylinder 10 to the printing nip between the blanket cylinders 10 and 20 where simultaneous recto-verso printing occurs. Once printed on both sides, the printed sheets are then transferred as known in the art to a chain gripper system 5 for delivery in a sheet delivery station 6 comprising multiple delivery piles (three in this example).

The chain gripper system 5 typically comprises a pair of chains holding a plurality of spaced-apart gripper bars (not shown) each provided with a series of grippers (designated by reference numeral 55 in FIG. 3) for holding a leading edge of the sheets. In the example of FIG. 1A, the chain gripper system 5 extends from below the two blanket cylinders 10, 20, through a floor part of the printing press and on top of the three delivery piles of the delivery station 6. The gripper bars are driven along this path in a clockwise direction, the path of the chain gripper system 5 going from the printing group to the sheet delivery station 6 running below the return path of the chain gripper system 5. A drying system 7 is disposed along the path of the chain gripper system 5 in order to dry both sides of the sheets, drying being performed using infrared lamps and/or UV lamps depending on the type of inks used. In this example, the drying system 7 is located at a vertical portion of the chain gripper system 5 where the gripper bars are led from the floor part of the printing press to the top of the sheet delivery station 6.

At the two extremities of the chain gripper system 5, namely below the blanket cylinders 10, 20 and at the outermost left-hand-side part of the sheet delivery station 6, there are provided pairs of chain wheels 51 and 52 for driving the endless chains of the chain gripper system 5.

In the example of FIGS. 1A and 1B, first and second transfer cylinders 60, 65 (such as suction drums or cylinders) are interposed between the pair of chain wheels 51 and the first blanket cylinder 10 so that printed sheets can be taken away from the surface of the first blanket cylinder 10 and then transferred in succession to the first transfer cylinder 60, to the second transfer cylinder 65 and finally to the chain gripper system 5.

Turning to the inspection system, the printing press shown in FIGS. 1A and 1B is further provided with two inspection devices 100 and 200 for taking images of both sides of the printed sheets, one side of the sheets being inspected by means of the first inspection device 100, while the other side of the sheets is inspected by means of the second inspection device 200. As illustrated in greater detail in FIG. 1B, the inspection device 100 comprises a line image sensor 110 (such as a CCD or CMOS color camera) for performing line-scanning image acquisition of one side of the printed sheets. "Line-scanning image acquisition" shall be understood as an image acquisition process whereby a surface or object is scanned line after line and the complete image of the surface or object is reconstructed from the plurality of scanned line portions. It is to be understood that line-scanning image acquisition involves a relative displacement of the image sensor with respect of the surface or object to be imaged. In this example, the relative displacement is caused by the rotation of the blanket cylinder 10 transporting the sheet to inspect.

More precisely, the inspection device 100 is disposed in such a way that the first line image sensor 110 visually acquires an image of a printed sheet while the printed sheet is still adhering onto the surface of the first blanket cylinder 10 of the printing press and immediately before the printed sheet is transferred to the down-stream located transfer cylinder 60. In the embodiment of FIGS. 1A and 1B, the first inspection device 100 further comprises a mirror 120 for diverting the optical path between the line image sensor 110 and the surface of the blanket cylinder 10. This mirror 120 advantageously permits to locate and orient the first inspection device 100 in a very compact manner in the printing press. More precisely, since the transfer cylinders 60, 65 and the chain wheels 51 of the chain gripper system 5 take a substantial amount of the available space immediately below the blanket cylinders 10, 20, the mirror 120 permits to go around the transfer cylinders 60, 65 and the chain wheels 51 and get access to the portion of the circumference of the blanket cylinder 10 between the printing nip and the sheet transfer location where the sheets are taken away from the blanket cylinder 10. As shown in FIGS. 1A and 1B, a light source 130 is further disposed immediately below the printing nip so as to illuminate the inspected zone on the sheet carried by the blanket cylinder 10.

The other inspection device 200 similarly comprises a line image sensor 210 (such as a CCD or CMOS color camera) for performing line-scanning image acquisition of the other side of the printed sheets while these are transported by the first transfer cylinder 60. No mirror is required in this case, as the first transfer cylinder 60 enables presenting the other side of the printed sheets directly in front of the line image sensor 210. A light source 230 is also disposed in order to appropriately illuminate the inspected zone on the sheet carried by the transfer cylinder 60.

In the example of FIGS. 1A and 1B, one side (hereinafter the "recto side") of each printed sheet is inspected by the first inspection device 100 while the sheet is still carried by the blanket cylinder 10 and the other side (hereinafter the "verso side") of the printed sheet is inspected by the second inspection device 200 while the sheet is carried by the first transfer cylinder 60. An alternate solution may consist in carrying out recto-verso inspection while the sheets are carried by the first and second transfer cylinders 60 and 65 as further discussed in International application No. WO 2007/105059 A1 and illustrated in FIG. 2 thereof. In any case, other solutions for carrying out inspection of the printed sheets are possible and can be envisaged within the scope of the invention.

Figure 2:
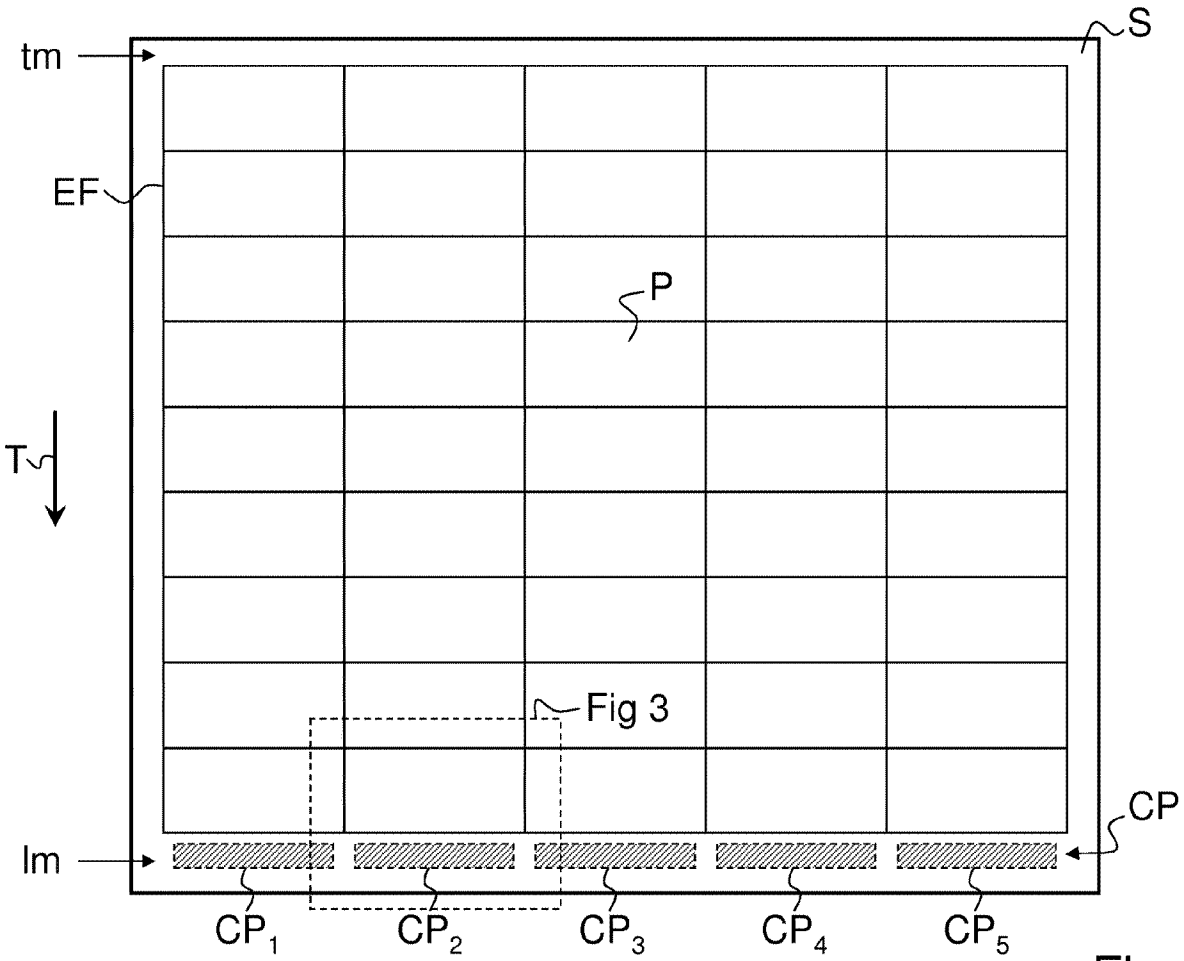
FIG. 2 is a schematic illustration of a printed substrate in the form of a sheet which bears a color control pattern for the optical measurement of the printed colors in accordance with a preferred embodiment of the invention.

FIG. 2 is a schematic illustration of a printed substrate in the form of a sheet, designated by reference S, which bears a color control pattern, designated generally by reference CP, for the optical measurement of the colors printed on the substrate S in accordance with a preferred embodiment of the invention.

As shown in FIG. 2, the sheet S exhibits an effective printed region EF where the desired multicolor patterns are printed. This effective printed region EF does not cover the whole surface of the sheet S and is surrounded by margin portions on all four sides. While this is not specifically illustrated in FIG. 2, patterns may be printed in the sheet margins for various purposes, including sheet marking and identification purposes as well as for the purpose of performing color control measurements.

FIG. 2 shows that the color control pattern CP is printed in a leading margin portion Im of the sheet S (i.e. at the leading edge of the sheet with respect to the direction of transport of the sheet shown by arrow T in FIG. 2) next to the effective printed region EF. The color control pattern CP may alternatively be provided in the trailing margin portion tm of the sheet S.

In the example shown in FIG. 2, the effective printed region EF consists of a matrix of individual multicolor prints P, such as multicolor security prints as for instance found on banknotes, which are arranged in multiple rows and columns. In this example, the effective printed region EF actually consists of five columns and nine rows of individual prints P (all print P bearing identical printed patterns), i.e. a total of forty-five prints P. This particular matrix arrangement is obviously purely illustrative.

As further illustrated in FIG. 2, the color control pattern CP extends transversely to the direction of transport T of the sheet S and comprises, in this preferred embodiment, an individual color control pattern $CP_1$, $CP_2$, $CP_3$, $CP_4$, $CP_5$ for each one of the five columns of individual multicolor prints P. According to this preferred embodiment, all individual color control patterns $CP_1$ to $CP_5$ are identical. As this will be appreciated from the following, the individual color control patterns $CP_1$ to $CP_5$ may however defer from one another depending on the relevant subdivision of ink zones.

In the context of the present invention, it will be assumed that the above-described inspection devices 100, 200 are both adapted to take an image of the entire sheet S (or substantially the whole surface thereof), including the effective printed region EF and the color control pattern CP. For the purpose of color measurement (and possibly automatic regulation of the inking units), it may however suffice to take only an image of the portion of the sheet S where the color control pattern CP is printed. It will also be appreciated that a color control pattern CP would in practice be provided on both sides of the sheets S (unless the printing press is only designed to print one side of the sheets at a time).

Figure 3:
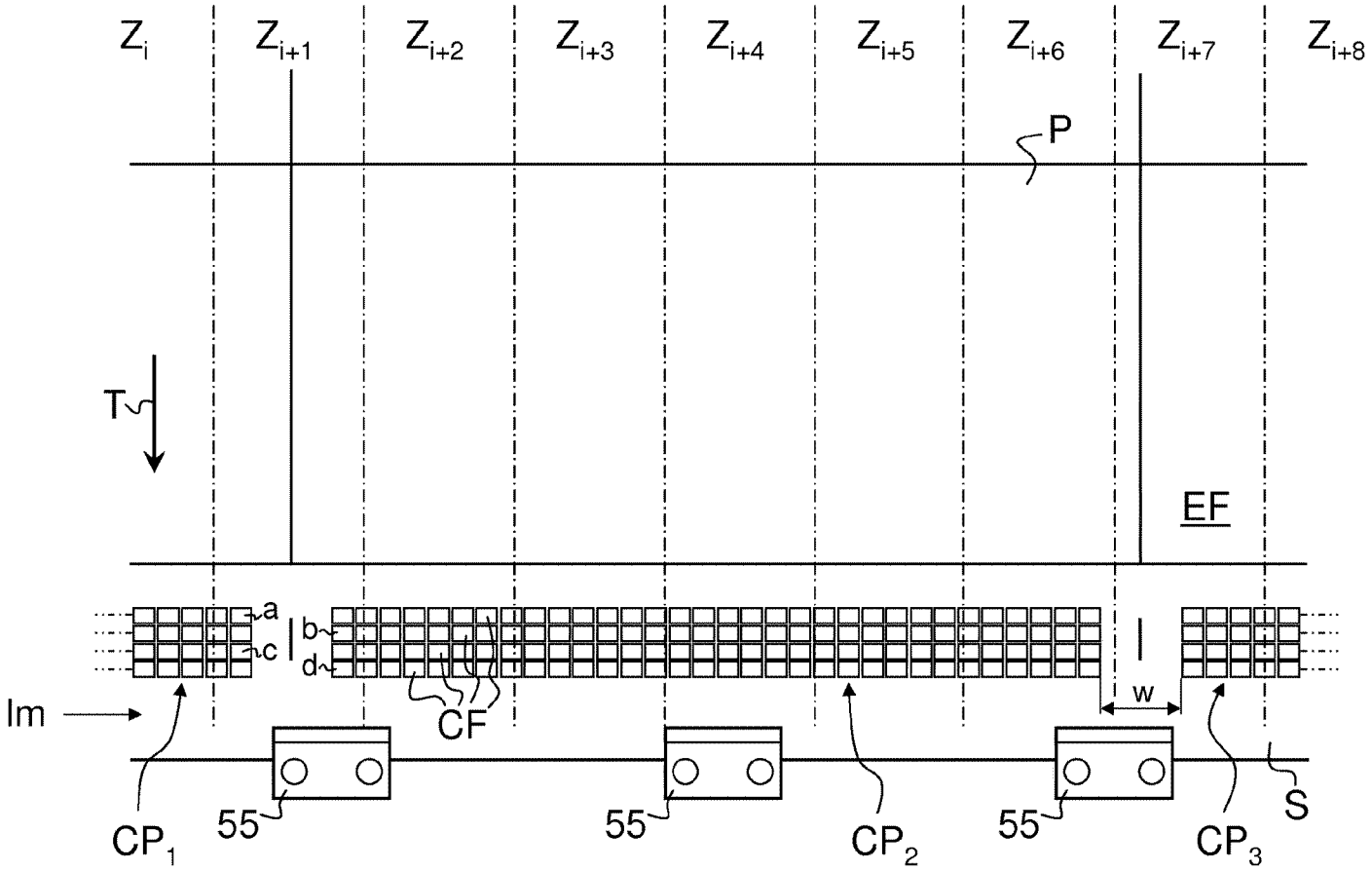
FIG. 3 is an enlarged schematic illustration of the printed substrate of FIG. 2 showing an individual color control pattern forming part of the color control pattern.

FIG. 3 is a detailed view of one of the individual color control patterns $CP_1$ to $CP_5$ of FIG. 2, namely of individual color control pattern $CP_2$ (as schematically indicated by the dashed rectangle in FIG. 2), which FIG. 3 also schematically shows grippers 55 of one of the gripper bars of the chain gripper system 5 of FIGS. 1A, 1B holding the leading edge of the sheet S. Portions of the adjacent color control patterns $CP_1$ and $CP_3$ are also visible in FIG. 3.

As shown in greater detail in FIG. 3, the color control pattern CP preferably comprises four distinct color control strips a, b, c, d which extend transversely to the direction of transport T of the substrate S (which configuration is reflected in the individual color control patterns $CP_1$ to $CP_5$), each color control strip a-d comprising a plurality of distinct color control fields CF consisting of printed fields of each relevant printing ink that is printed in the effective printed region EF.

In this particular example, each individual color control pattern consists of up to thirty-two color control fields CF along each color control strip a, b, c, d, i.e. a total of hundred and twenty-eight color control fields CF are provided in each individual color control pattern. As this will be described hereinafter, these color control fields CF are coordinated to the actual application of the relevant printing inks in the effective printed region EF and are positioned transversely to the direction of transport T of the sheet S at locations corresponding to the actual positions where the relevant printing inks are applied in the effective printed region EF. The number of color control fields CF is purely illustrative and actually depends on various factors, including the length (transversely to the direction of transport T) of each individual print and the dimensions of each color control field CF.

In the particular example of FIGS. 2 and 3, it may be appreciated that each individual color control pattern $CP_1$ to $CP_5$ (and the color control fields CF thereof) is positioned in dependence of the actual design printed in the effective region EF, i.e. in dependence of each column of individual prints P.

According to the preferred embodiment of FIGS. 2 and 3, one may further appreciate that the individual color control patterns $CP_1$ to $CP_5$ are separated from one another by an unprinted region where the columns of individual multicolor prints P adjoin. This unprinted region preferably has a minimum width w of 5 mm. This is in essence useful in that the sheets S are ultimately cut column-wise and row-wise to form individual security documents, such as banknotes, and in that the unprinted region between the individual color control patterns $CP_1$ to $CP_5$ are preferably exploited for the provision of reference marks for the cutting process. The color control pattern CP may however extend quasi continuously along substantially the whole width of the sheet S if this is useful or necessary.

In FIG. 3, one has further depicted by dash lines the corresponding subdivision in a plurality of adjoining ink zones $Z_i$, $Z_{i+1}$, $Z_{i+2}$, . . . , transversely to the direction of transport T of the sheet S. These ink zones $Z_i$, $Z_{i+1}$, $Z_{i+2}$, . . . , illustrate the relevant positions where ink is supplied in the corresponding inking units of the printing press and where ink adjustments can be made. Nine ink zones are depicted in FIG. 3, but it should be appreciated that each inking unit comprises a greater number of such ink zones, typically of the order of thirty.

In contrast to the known solutions, it may already be appreciated that the color control pattern CP is not designed in accordance with the ink zone subdivision, but in accordance with the actual printed image that is printed in the effective printed region EF.

As the matrix arrangement of individual prints P does not (necessarily) match the ink zone subdivision (i.e. the length of each individual print P transversely to the direction of transport T of the sheet S is generally not an integer multiple of the ink zone width), this also means that the distribution of the relevant color control fields CF will differ from one ink zone to the other. This may for instance be appreciated by comparing the distribution of the color control fields CF in ink zone $Z_{i+1}$, where color control fields CF of the first and second color control patterns $CP_1$ and $CP_2$ are present, with that of the color control fields CF in ink zone $Z_{i+7}$ where only part of the color control fields CF of the third color control pattern $CP_3$ are present. As a consequence, it should also be appreciated that the relationship between the ink zone subdivision and the individual color control patterns (and associated color control fields) will typically differ from one column of prints P to the other.

Depending on the actual printed design (and possibly other factors such as the presence of interfering features present into or onto the sheet S), it may not actually be possible to provide (or measure) all relevant color control fields CF of the desired colors in each ink zone where the corresponding inks are applied. In such a case, it may suffice to provide such a color control field CF in one or both of the immediately adjacent ink zones and derive a color measurement from this other color control field CF. While this does not allow a direct measurement of the desired color in the relevant ink zone, this may nevertheless enable the operator to derive an indirect measurement of the relevant color in the desired ink zone.

Preferably, the color control pattern CP should be designed in such a way that at least one color control field CF (ideally more than one) of each relevant color is provided within each ink zone where the corresponding printing is applied.

Figure 4:
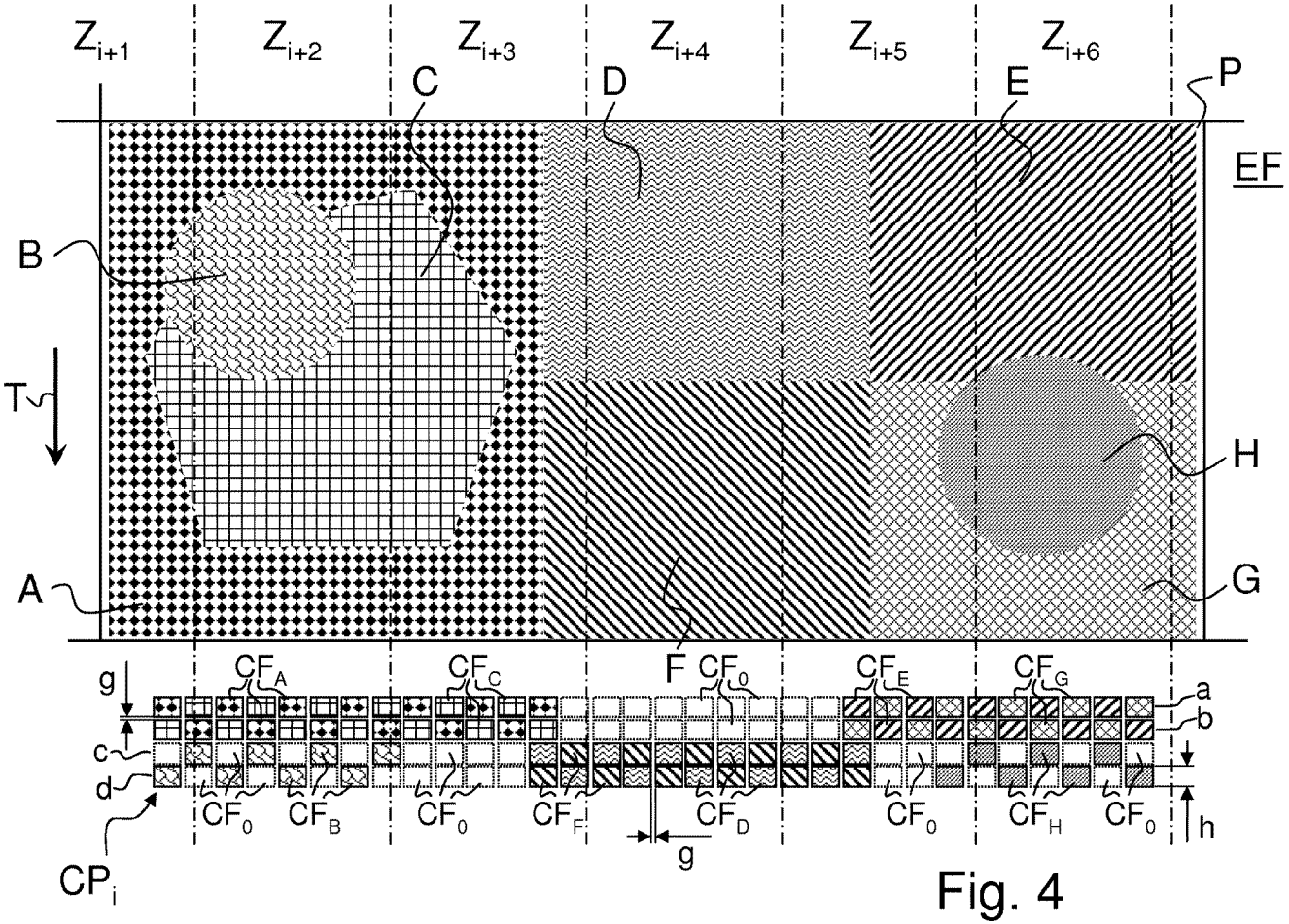
FIG. 4 is a schematic illustration of a possible design of the color control pattern according to the invention in the context of an illustrative and non-limiting example of a multicolor print with a plurality of juxtaposed color areas of different colors.

FIG. 4 is a schematic illustration of a possible design of a color control pattern CP (or more exactly of the individual color control pattern $CP_i$) according to the invention in the context of an illustrative and non-limiting example of a multicolor print P with a plurality of juxtaposed color areas of different colors A to H.

The illustration of FIG. 4 follows the same general design rules as in FIG. 3, i.e. the color control pattern $CP_i$ comprises four distinct color control strips a, b, c, d, each comprising a plurality of color control fields.

As schematically illustrated in FIG. 4, each individual print P of the matrix printed in the effective printed region EF comprises an identical multicolor printed image comprising a plurality of juxtaposed colored areas A to H printed with a corresponding plurality of printing inks of different colors. While eight different colored areas A to H are depicted, it should be appreciated that a lesser or greater number of different colored areas could be provided in practice. In addition, while the illustrations of FIGS. 1A and 1B show a machine with four plates cylinders 15, 25 for each side, two inking devices are provided in each ink unit 13, 23, meaning that at least eight colors on each side could be printed (or more through the use of appropriate ink fountain separators).

While FIG. 4 may suggest that the entire surface of each individual print P is covered with colored areas A to H, it should however be appreciated that portions of each individual print P may be left blank (such as in regions of the sheets provided with watermarks). The actual design of each individual print P and the corresponding distribution of the various colored areas will obviously be design-dependent and the example of FIG. 4 should not therefore be considered as limiting the scope of the invention and the applicability thereof.

As illustrated in the example of FIG. 4, color control fields $CF_A$ to $CF_H$ corresponding to each one of the relevant colors printed in areas A to H are suitably defined at relevant locations of the (individual) color control pattern $CP_i$. As already mentioned hereinabove, the relevant color control fields $CF_A$ to $CF_H$ are coordinated, as illustrated, to the actual application of the relevant printing inks in the effective printed region EF (i.e. in each individual print P according to this preferred embodiment) and are positioned transversely to the direction of transport T of the sheet S at locations corresponding to actual positions where the relevant printing inks are applied.

In the illustrated example, the color control fields $CF_A$, $CF_B$ and $CF_C$ corresponding to areas A to C are concentrated on the left-hand side of the color control pattern $CP_i$ while the remaining color control fields $CF_D$ to $CF_H$ corresponding to areas D to H are located on the right-hand side of the color control pattern $CP_i$.

As shown in FIG. 4, the color control fields $CF_A$ to $CF_H$ are distributed between the various color control strips a-d in an alternate manner so as to provide room for all necessary color control fields. FIG. 4 shows unused/available color control fields $CF_0$ (which are depicted in dotted line) which could be exploited for the measurement of additional colors or, depending on the design, to allow for the provision of a greater number of different color control fields in any given portion of the color control pattern $CP_i$ transversely to the direction of transport T of the sheet S.

As illustrated in FIGS. 3 and 4, the color control fields should preferably have a rectangular or square shape (even though other shapes, especially more complex shapes, are possible) with a minimum height h along the direction of transport T of the sheet S. In practice, a minimum height of the order of 3 mm is sufficient.

As further illustrated in FIGS. 3 and 4, it is advantageous to design the color control pattern in such a way that the color control fields are separated from one another by an unprinted gap. This favours a better recognition and identification of each individual color control fields by an image processing system. This unprinted gap between the color control fields should preferably have a minimum width of the order of 0.4 mm (both along and transversely to direction T) to enable proper discrimination of the individual color control fields.

In FIG. 4, one has also depicted by dash lines a corresponding subdivision in a plurality of adjoining ink zones $Z_{i+1}$, $Z_{i+2}$, . . . , transversely to the direction of transport T of the sheet S. This particular ink zone subdivision corresponds to that shown in FIG. 3 in relation to the second color control pattern CP2. It is to be appreciated again that this ink zone subdivision will be different for the other columns of imprint P. As this has already been mentioned hereinabove, the color control pattern is preferably designed in such a way that at least one color control field $CF_A$, $CF_B$, . . . , $CF_H$ of each relevant color is provided within each ink zone where the corresponding printing ink is applied, as this is represented in FIG. 4.

In FIG. 4, it may be appreciated that an outermost right-hand portion of the individual print P extends beyond ink zone $Z_{i+6}$ in the subsequent ink zone (i.e. ink zone $Z_{i+7}$ in FIG. 3). Measurement of the inks applied in this portion of the individual print P (i.e. the printing inks used for areas E and G) could be performed in the color control fields of the next color control pattern (i.e. $CP_3$), in which case corresponding color control fields $CF_E$ and $CF_G$ would have to be provided at the outermost left-hand side of color control pattern $CP_3$, in ink zone $Z_{i+7}$ of FIG. 3. Alternatively, a measurement for ink zone $Z_{i+7}$ of FIG. 3 could be inferred from measurements carried out in the color control fields $CF_E$ and $CF_G$ that are provided in ink zone $Z_{i+6}$.

The above-described color control pattern can be suitably used for performing color measurements, especially on substrates carrying multicolor prints for the production of security documents, such as banknotes. Such color measurements can be carried out off-line by means of a dedicated measurement tool or in-line on the printing press. In this latter case, and taking the example of FIGS. 1A and 1B as a possible implementation, the inspection devices 100 and 200 would be used as an optical measurement system to carry out the measurements of the colors printed on the sheets by way of corresponding color control patterns printed on both sides of the sheets.

Preferably, such in-line color measurement is carried out on a multicolor offset printing press for the production of security documents, advantageously on a Simultan-type offset printing press for the simultaneous recto-verso printing of sheets (or webs) as depicted for instance in FIGS. 1A and 1B.

Figure 5:
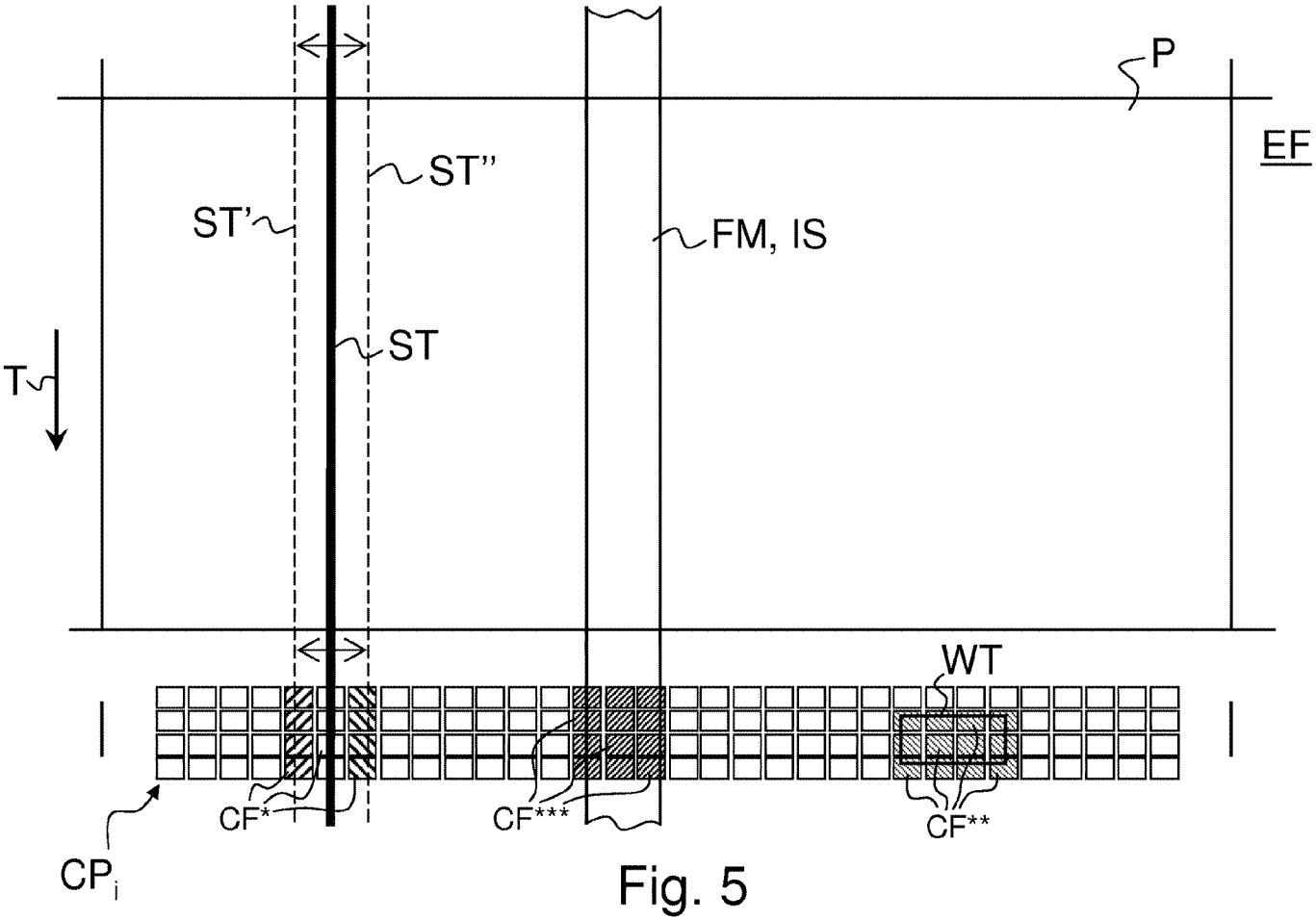
FIG. 5 is a schematic illustration of the impact on the color control pattern of the invention of features embedded within, applied or printed onto, or otherwise provided on or in the substrate.

In the context of the production of security documents, features embedded within the substrate (such as security threads or watermarks), applied or printed onto the substrate (such as foil material or iridescent stripes), or like features provided in or on the substrate may partly affect measurements in portions of the color control pattern. FIG. 5 schematically illustrates such a situation where ST designates a security thread, WT a watermark located (at least partly) in the same region where the color control pattern $CP_i$ is present, and FM, respectively IS, a strip of foil material applied, respectively an iridescent stripe printed on the substrate S along a direction parallel to the direction of transport T of the substrate S. Such features are commonly provided on most banknote substrates an can potentially interfere with or affect the measurements carried out in the color control pattern $CP_i$. Some of these features may furthermore move, transversely to the direction of transport T of the substrate S, from one substrate S to the other and/or from one column of prints P to the other, which is for instance typically the case of security threads. This is schematically depicted in FIG. 5 where references ST' and ST" designate two other possible positions of the security thread ST.

As shown in FIG. 5, these various features (which may not be all present at the same time) may partly affect portions of the color control pattern $CP_i$, which portions are highlighted in the drawing by corresponding color control fields CF*, CF and CF*. Optical measurements carried out in those locations may not be proper as they could not adequately reflect the actual density of ink applied on the substrate. It is therefore preferable not to consider these affected color control fields CF*, CF and CF* for the purpose of color measurement. This can be performed manually or semi-automatically by either masking out the relevant portions of the color control pattern $CP_i$ or by disregarding potential measurement peaks.

Depending on the actual printed design, entire portions of the color control pattern may ultimately be unusable for the purpose of carrying out color measurements. In such a case, the color control pattern needs to be designed in such a way as to cope with such situations and ensure that at least one color control field is present in the vicinity of the location where a measurement would have to be undertaken, possibly in one or both of the immediately adjacent ink zones.

The above-described color control pattern may be used for other purposes than merely for the purpose of carrying out color measurements. Advantageously, the color control pattern of the invention could be used for automatically adjusting and/or setting inking units of a multicolor printing press, especially of a multicolor security printing press of the type shown in FIGS. 1A and 1B. In this way, one can build a complete closed-loop color control system for automatic ink control of a security printing press for the production of security documents.

Any suitable methodology for performing automatic ink control of the security printing press can potentially be applied as long as it is capable of making use of the color control pattern of the invention. A preferred methodology which can suitably be used with the color control pattern of the invention is the one disclosed in International application No. WO 2007/110317 A1, which publication is discussed in the preamble hereof and is incorporated by reference in its entirety.

Figure 6:
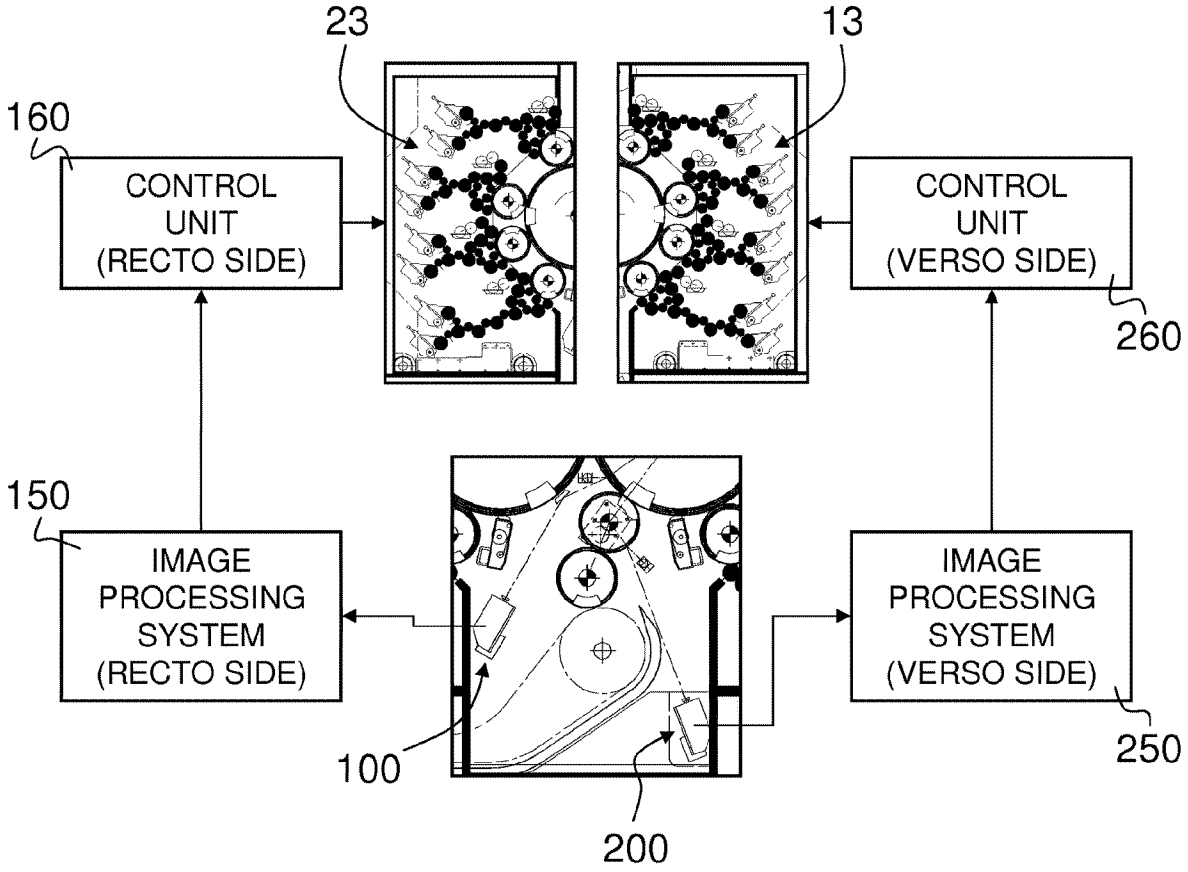
FIG. 6 is a schematic diagram of a possible closed-loop color (ink) control system for the automatic adjustment and setting of the inking units of the printing press of FIGS. 1A and 1B.

FIG. 6 is a schematic diagram of a possible closed-loop color control system for the automatic adjustment and setting of the inking units 13, 23 of the printing press of FIGS. 1A and 1B. It is understood that a color control pattern as described above would be provided on both sides of the printed sheets with a view to be measured optically by the first inspection system 100 (on the recto side) and by the second inspection system 200 (on the verso side).

Each inspection system 100, 200 would output corresponding digital image data to first and second image processing systems 150, 250, which image processing systems 150, 250 would perform the necessary processing to extract the required color measurements from the corresponding color control patterns. The results of such color measurements could be displayed to an operator on dedicated screens (not shown) for information and monitoring purposes, and possible manual adjustments, if required.

Automatic adjustment and setting of the inking units 13, 23 of the printing press would be carried out on the basis of the optical color measurements derived by the relevant image processing systems 150, 250 in dependence of predetermined reference settings as for instance disclosed in International application No. WO 2007/110317 A1. To this end, appropriate control units 160, 260 for controlling each set of inking units 13, 23 are provided, which control units 160, 260 receive the necessary input signals for effecting ink adjustments from the relevant image processing systems 150, 250. It is to be appreciated that adjustment of the inks printed on the recto side is performed by way of adequate settings of the inking units 23 under the control of unit 160, while adjustment of the inks printed on the verso side is performed by way of adequate settings of the inking units 13 under the control of unit 260.

As this is self-evident from reading the above description, the invention also relates to and encompasses any printed substrate comprising a color control pattern according to the invention, which color control pattern is printed on one or both sides of the substrate. Similarly, the invention also relates to and encompasses any set of printing plates for the impression of a color control pattern according to the invention, wherein each of the printing plates of the set comprises a relevant subset of the color control fields forming the color control pattern.

As regards the above-described color control pattern, it should further be appreciated that such color control pattern would typically be prepared jointly with the corresponding design and origination of the printing plates. Nowadays, such preparation is typically carried out on digital prepress systems. The claimed color control pattern therefore also encompasses any digital version of the color control pattern, in addition to its actual, tangible realization on the relevant printed substrates.

Various modifications and/or improvements may be made to the above-described embodiments without departing from the scope of the invention as defined by the annexed claims. For instance, while the invention was described in the context of a printing press adapted for sheet printing, the invention is equally applicable to the printing on a continuous web of material.

Furthermore, while the invention was specifically devised with the goal to find a suitable solution for application to security printing, the invention could nevertheless still be applied in commercial printing, especially in the case where special colors are used in addition to or as a replacement of the usual four primary colors used in commercial printing.

It is also possible to make use of any other type of inspection system than that shown in FIGS. 1A and 1B as long as such inspection system is capable of carrying out measurement in the area where the color control pattern is provided.

LIST OF REFERENCES USED HEREIN

1 feeding station
2 feeder table
3 transfer cylinders
5 chain gripper system (with spaced-apart gripper bars)
6 sheet delivery station
7 drying system
10 (first) blanket or impression cylinder (three-segment cylinder)
13 inking units (four pairs) on right-hand side of printing group
15 plate cylinders (four cylinders each carrying one printing plate) on
right-hand side of printing group
20 (second) blanket or impression cylinder (three-segment cylinder)
23 inking units (four pairs) on left-hand side of printing group
25 plate cylinders (four cylinders each carrying one printing plate) on
left-hand side of printing group
51 chain wheels (upstream section)
52 chain wheels (downstream section)
55 grippers of gripper bars of chain gripper system 5
60 first transfer cylinder (e.g. suction drum or cylinder)
65 second transfer cylinder (e.g. suction drum or cylinder)
100 (first) inspection device for taking an image of the recto side of the
sheets
110 (first) line image sensor (e.g. CCD or CMOS color camera)
120 mirror (first inspection device)
130 light source (first inspection device)
150 image processing system for optical color measurements (recto
side)
160 control unit for automatic adjustment/setting of inking units 23
(recto side)
200 (second) inspection device for taking an image of the verso side of
the sheets
210 (second) line image sensor (e.g. CCD or CMOS color camera)
230 light source (second inspection device)
250 image processing system for optical color measurements (verso side)
260 control unit for automatic adjustment/setting of inking units 23 (verso side)
S sheet or web substrate (e.g. sheet)
EF effective printed region having a multicolor printed image
P individual (multicolor) prints
A-H juxtaposed colored areas printed with corresponding printing inks of different colors
T direction of transport of substrate S
tm trailing margin of substrate (downstream of effective printed region EF)
lm leading margin of substrate (upstream of effective printed region EF)
CP color control pattern
$CP_i/CP_{1-5}$ individual color control pattern(s)
$CF/CF_{A-H}$ color control fields
$CF_0$ available/unused color control fields
a, b, c, d color control strips
$Z_{i+j}$ ink zones (j=0, 1, 2, 3, . . . )
w width of unprinted region between individual color control patterns $CP_i/CP_{1-5}$ (transversely to direction of transport T)
h height of color control fields $CF/CF_{A-H}$ (along direction of transport T)
g gap (vertical & horizontal) between color control fields $CF/CF_{A-H}$
ST, ST', ST" moving security thread embedded in substrate S
WT watermark
FM foil material applied onto substrate S
IS iridescent stripe printed (or otherwise provided) on substrate S
CF*, CF, CF* portions of color control pattern CP which are potentially not considered for the purpose of color measurement

The invention claimed is:

1. A color measurement system comprising an optical measurement system, and a printed sheet or web substrate comprising a color control pattern for the optical measurement of colors printed on the sheet or web substrate with a multicolor printing press, said substrate comprising an effective printed region having a multicolor printed image having a plurality of juxtaposed colored areas printed with a corresponding plurality of printing inks of different colors, wherein the color control pattern is printed in a margin portion of the substrate next to the effective printed region, the color control pattern comprising one or more color control strips extending in a direction transverse to a direction of transport of the substrate, each color control strip comprising a plurality of distinct color control fields consisting of fields of each relevant printing ink that is printed in the effective printed region, wherein the color control fields are coordinated to the relevant printing inks in the effective printed region such that the color control pattern can be divided into transverse sections along the transverse direction and each respective transverse section exhibits all printing inks that appear in a corresponding section of the effective printed region that is spaced from its transverse section only in the transport direction, wherein the effective printed region consists of a matrix of individual multicolor prints arranged in multiple rows and columns and wherein the color control pattern comprises an individual color control pattern for each column of individual multicolor prints, wherein the optical measurement system measures the colors printed on the sheet or web substrate in the color control pattern wherein at least one color control strip exhibits less than all of the plurality of printing inks of different colors.

2. The color measurement system according to claim 1, wherein a plurality of adjoining ink zones are defined transversely to the direction of transport of the substrate and wherein the color control pattern is designed in such a way that all relevant colors that are applied within each ink zone can be measured.

3. The color measurement system according to claim 2, wherein the color control pattern is designed in such a way that at least one color control field of each relevant color is provided within each ink zone where the corresponding printing ink is applied.

4. The color measurement system according to claim 1, wherein all individual color control patterns are identical in size.

5. The color measurement system according to claim 1, wherein the individual color control patterns are separated from one another by an unprinted region where the columns of individual multicolor prints adjoin.

6. The color measurement system according to claim 5, wherein the unprinted region has a minimum width of 5 mm.

7. The color measurement system according to claim 1, wherein the color control fields are rectangular or square fields.

8. The color measurement system according to claim 7, wherein the color control fields have a minimum height of 3 mm along the direction of transport of the substrate.

9. The color measurement system according to claim 1, wherein the color control fields are separated from one another by an unprinted gap.

10. The color measurement system according to claim 9, wherein the unprinted gap has a minimum width of 0.4 mm.

11. The color measurement system according to claim 1, wherein the color control pattern comprises a plurality of color control strips.

12. The color measurement system according to claim 11, wherein the color control pattern comprises up to four color control strips.

13. The color measurement system according to claim 1, wherein the color control pattern is printed on one or both sides of the substrate.

14. The color measurement system according to claim 4, wherein all individual color control patterns are identical in shape.

* * * * *